US009676082B1

(12) United States Patent
Schoolland

(10) Patent No.: US 9,676,082 B1
(45) Date of Patent: Jun. 13, 2017

(54) FASTENER REMOVAL TOOL

(71) Applicant: John Schoolland, Thousand Oaks, CA (US)

(72) Inventor: John Schoolland, Thousand Oaks, CA (US)

( * ) Notice: Subject to any disclaimer, the term of this patent is extended or adjusted under 35 U.S.C. 154(b) by 0 days.

(21) Appl. No.: 15/069,093

(22) Filed: Mar. 14, 2016

(51) Int. Cl.
*B25B 7/04* (2006.01)
*B25B 13/48* (2006.01)

(52) U.S. Cl.
CPC ..... *B25B 7/04* (2013.01); *B25B 13/48* (2013.01)

(58) Field of Classification Search
CPC .. B25B 7/04; B25B 7/10; B25B 13/48; B25B 13/5008; B25B 13/5041
USPC ..... 81/384, 98
See application file for complete search history.

(56) References Cited

U.S. PATENT DOCUMENTS 63,689 A * 4/1867 Bain ..... B25B 7/10 81/394
282,768 A * 8/1883 Pollard ..... B25B 13/505 81/98
1,538,790 A * 5/1925 Forney ..... B25B 7/02 81/13
1,935,009 A * 11/1933 Bluhm ..... B25B 7/12 81/111
4,854,198 A 8/1989 Batten
5,743,158 A 4/1998 Perkins
6,666,113 B1 * 12/2003 Bravo ..... B25B 13/505 81/111
8,978,523 B2 3/2015 Stanfield et al.

* cited by examiner

*Primary Examiner* — Hadi Shakeri
(74) *Attorney, Agent, or Firm* — Kelly & Kelley, LLP

(57) ABSTRACT

A hand wrenching tool includes a first handle having a socket head at one end thereof configured to receive a collar of a fastener. A second handle is pivotally connected to the first handle and has a jaw at an end thereof. A collar engaging cam surface of the jaw pushes the collar into teeth of the socket as the first and second handles are pivoted towards one another, facilitating the removal of the collar from a threaded pin of the fastener as the hand wrenching tool is manually rotated.

7 Claims, 11 Drawing Sheets

FASTENER REMOVAL TOOL

BACKGROUND OF THE INVENTION

The present invention generally relates to wrenching and removal tools. More particularly, the present invention relates to a hand wrenching tool for removing fasteners, and particularly torque controlled or frangible collar fasteners.

For many decades, the aerospace industry has made use of frangible fasteners, sometimes referred to as "broached-pin" fastening systems, such as the Hi-Lok® fastening system. While there are many variations, all have in common a method of keeping the bolt or pin from rotating while a nut element is threaded onto it and tightened to a predetermined torque. Such frangible fasteners are used extensively in the aerospace industry due to their simplicity, consistently controlled pre-load torque and minimum size and weight.

FIGS. 1-3 illustrate a typical frangible fastening system. A pin 10 is extended through the objects 12 and 14 to be fastened to one another, as illustrated in FIGS. 1 and 2. The objects 12 and 14 can comprise sheets of metal of an aircraft skin, for example. The pin 10 includes a head 16 at one end and a threaded portion 18 at a generally opposite end.

The threaded portion 18 of the pin extends beyond the aligned objects 12 and 14. Access to the head 16 of the pin 10 is usually not possible, and for reasons of weight saving and aerodynamics, the heads 16 of the fasteners are typically flat so as to be flush with the skin of the aircraft structure or only to protrude slightly. The head 16 typically does not have any external "hex" or other shape to grip with a wrench to keep the pin 10 from rotating and turning. Instead, the threaded end 18 of the pin 10 is provided with an internal multi-faceted recess, such as an internal hex recess 20 into which a hex-Allen key wrench may be inserted to hold the pin 10 stationary while an internally threaded nut 22 is fastened thereto.

The nut 22 includes an internally threaded collar portion 24 and a wrenching ring 26. The wrenching ring 26 is configured to engage a socket, such as being of a hex shape. An intermediate portion between the collar 24 and the wrench ring 26 is designed to shear once a predetermined torque is achieved, resulting in the frangible wrenching ring portion 26 being removed from the collar portion 24 of the nut 22 when the applied torque exceeds a predetermined torsional loading, as illustrated in FIG. 2.

FIG. 3 illustrates a series of frangible fasteners which have been fastened so that the wrenching ring 26 has been removed and the collar 24 is attached to the pin 10 to secure the sheets or objects of material 12 and 14 to one another. Also shown are nuts 22 which have been threaded onto the threaded portion 18 of the pin 10 but not yet tightened sufficiently to remove the wrenching ring 26 portion thereof and ends of pins 10 ready to receive a nut 22 thereon. When the wrenching tool engages the wrenching ring 26 portion to apply rotational force to the threaded collar 24 and twist the nut 22 onto the pin 10 until the predetermined torsional loading or torque is exceeded, at which point the wrenching ring 26 will break off.

It is frequently desirable to loosen or remove the threaded collar 24 from the assembled fastener. The threaded collar commonly has a generally cylindrical base 28 which tapers into a smaller diameter cylindrical neck 30. The cylindrical portions of such collars 24 are narrow and are difficult to grasp with conventional tools, such as pliers, vice grip clamps, and the like. Additionally, the use of non-standard tools for loosening or removing the torque limited fastener is objectionable as such tools can damage the surfaces of the assembled parts, and fail to provide the required torque to loosen the fasteners.

Accordingly, there is a continuing need for a hand wrenching tool which is of a simple design, yet efficiently serves the purpose of loosening and removing fasteners that are commonly utilized in the aerospace industry. The present invention fulfills these needs and provides other related advantages.

SUMMARY OF THE INVENTION

The present invention resides in a hand wrenching tool for removing installed fasteners, and particularly installed collars of torque controlled or frangible fasteners. The tool includes a first elongated handle providing a grip at one end thereof and a socket head at a generally opposite end thereof. The socket head defines a cavity configured to receive a collar of the torque controlled fastener therein. The socket head may comprise a through aperture.

The socket head has an interior wall defining a plurality of teeth. The teeth may comprise ridges formed from a plurality of cut outs formed in the interior wall of the socket. Typically, the cut outs extend from substantially an upper edge to a lower edge of the socket wall. The cut outs may be disposed at varying distances to one another to accommodate collars of different sizes.

A second elongated handle is pivotally connected to the first elongated handle. The second handle has a grip at one end thereof and a jaw at an opposite end thereof. The jaw has a collar engaging surface, which is curved or arcuate. The arcuate surface of the jaw preferably forms a cam surface.

The first handle may include a landing defined by an area of decreased cross-section thickness intermediate the socket head and the gripping portion. The second handle may also include a landing defined by an area of decreased cross-sectional thickness intermediate the jaw and the gripping portion of the second handle. The landings of the first and second handles overlie one another to permit the first and second handles to be pivotally moved with respect to one another.

The first handle and the second handle may be adjustably connected to one another to permit the distance between the teeth and the jaw to be varied to accommodate collars of different sizes. For example, one of the first or the second handle may include a series of connecting apertures alignable with a connecting aperture of the other first or second handle for insertion of a connector therein to adjust the distance between the teeth and the jaw.

The socket head and the jaw are configured to be placed adjacent to a work surface, while providing hand gripping clearance between the work surface and the gripping portions of the first and second handles.

Upon pivoting the grips of the first and second handles towards one another, the cam surface of the jaw increasingly projects into the socket and pushes the collar of the fastener into engagement with the socket teeth to facilitate the removal of the collar from a threaded pin of the fastener as the hand wrenching tool is thereafter manually rotated.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
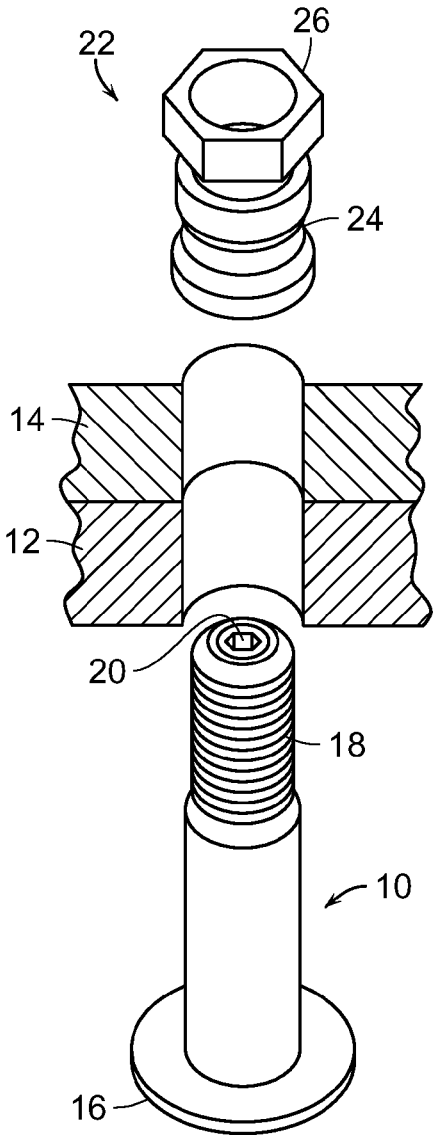
FIG. 1 PRIOR ART
FIG. 1 is a partially sectioned and perspective view of a prior art frangible fastener for attaching two sheets of material to one another, as is known in the prior art.
Figure 2:
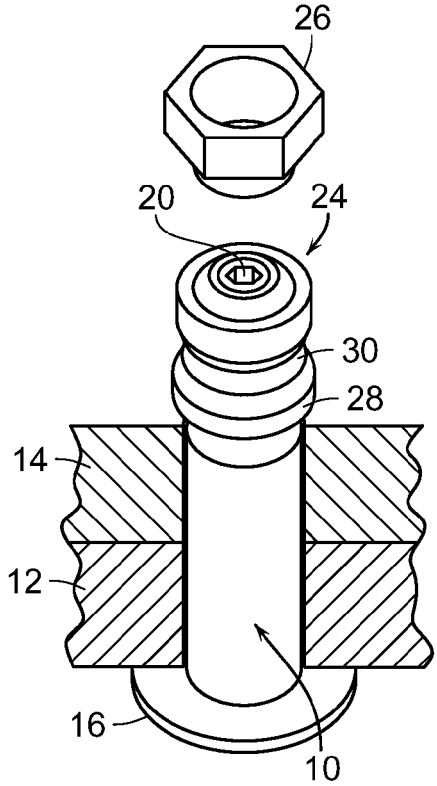
FIG. 2 PRIOR ART
FIG. 2 is a view similar to FIG. 1, but illustrating a frangible ring detached from a collar portion of the assembled fastener.
Figure 3:
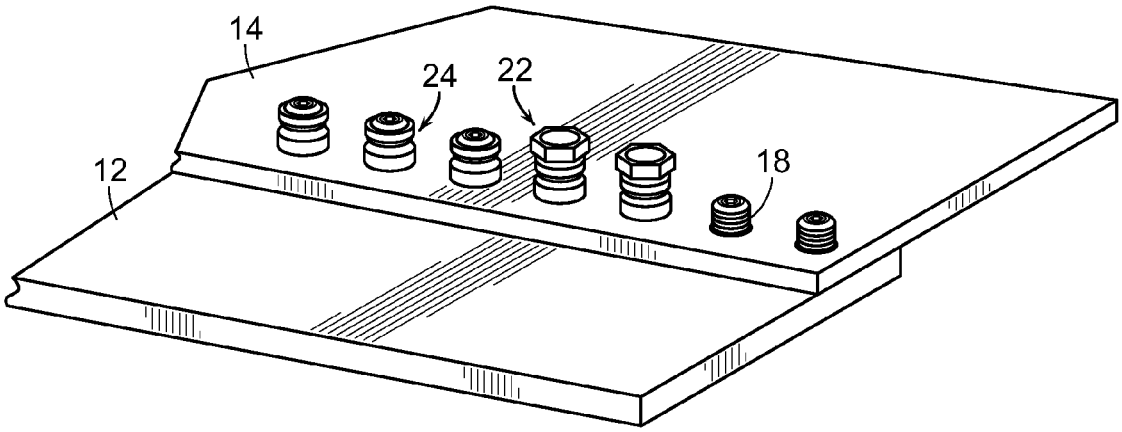
FIG. 3 PRIOR ART
FIG. 3 is a perspective view illustrating frangible fasteners attaching two sheets of material together, as is known in the prior art.

As shown in the accompanying drawings, for purposes of illustration, the present invention is directed to a hand wrenching tool, generally referred to herein by the reference number 100, for removing installed fasteners, and particularly collars 24 of torque controlled or frangible fasteners which have been previously attached to the threaded end 18 of pins 10 to join sheets or objects 12 and 14 to one another. It can be seen that the remaining collars 24 lack flat surfaces to which conventional hand wrenching tools, sockets, and the like can engage and grasp to remove the collar. Instead, the collars 24 have generally smooth surfaces which vary in diameter across a length thereof.

Figure 4:
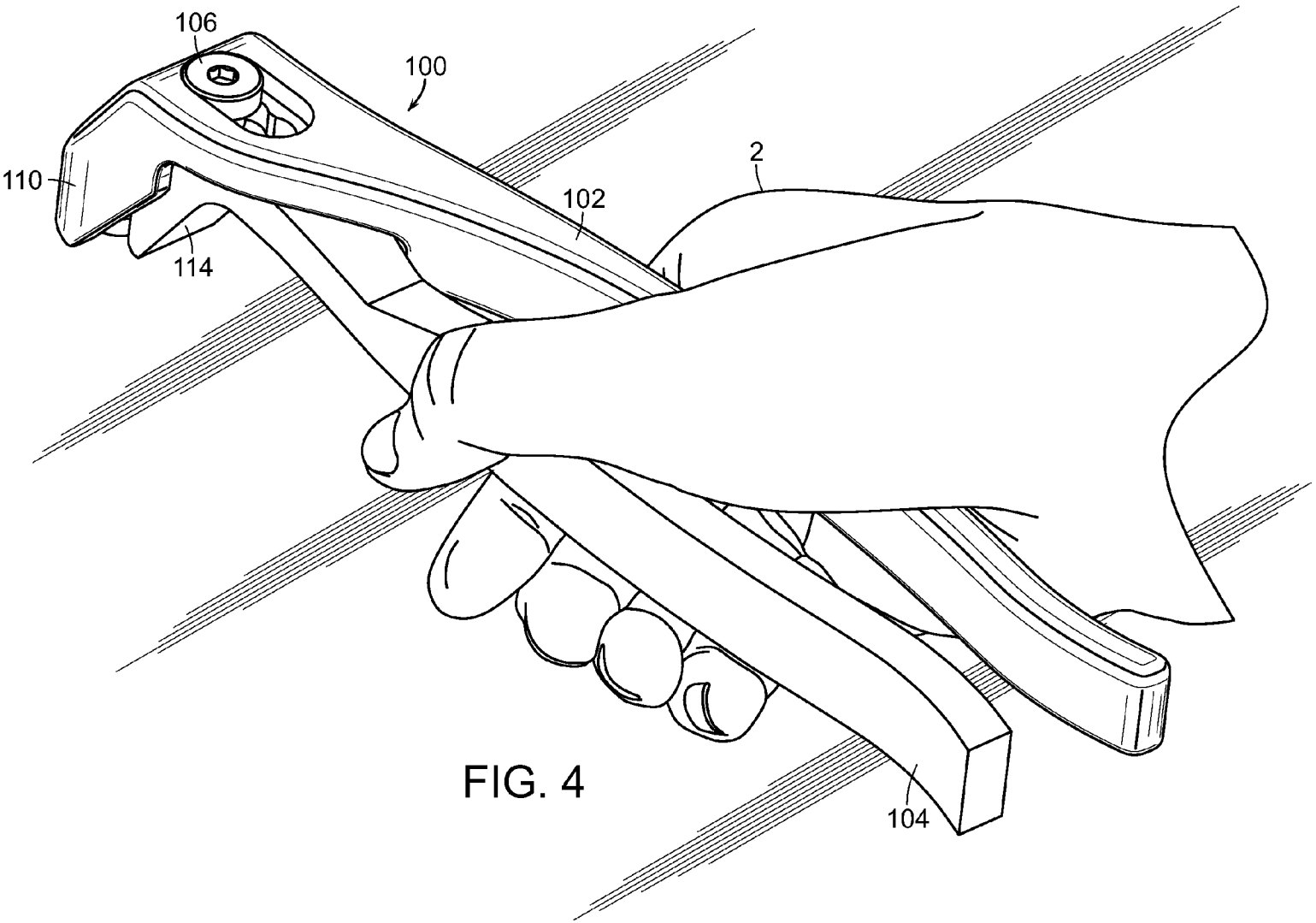
FIG. 4 is a perspective view of a fastener removal tool embodying the present invention, and grasped by a hand of the user thereof, in accordance with the present invention.
Figure 5:
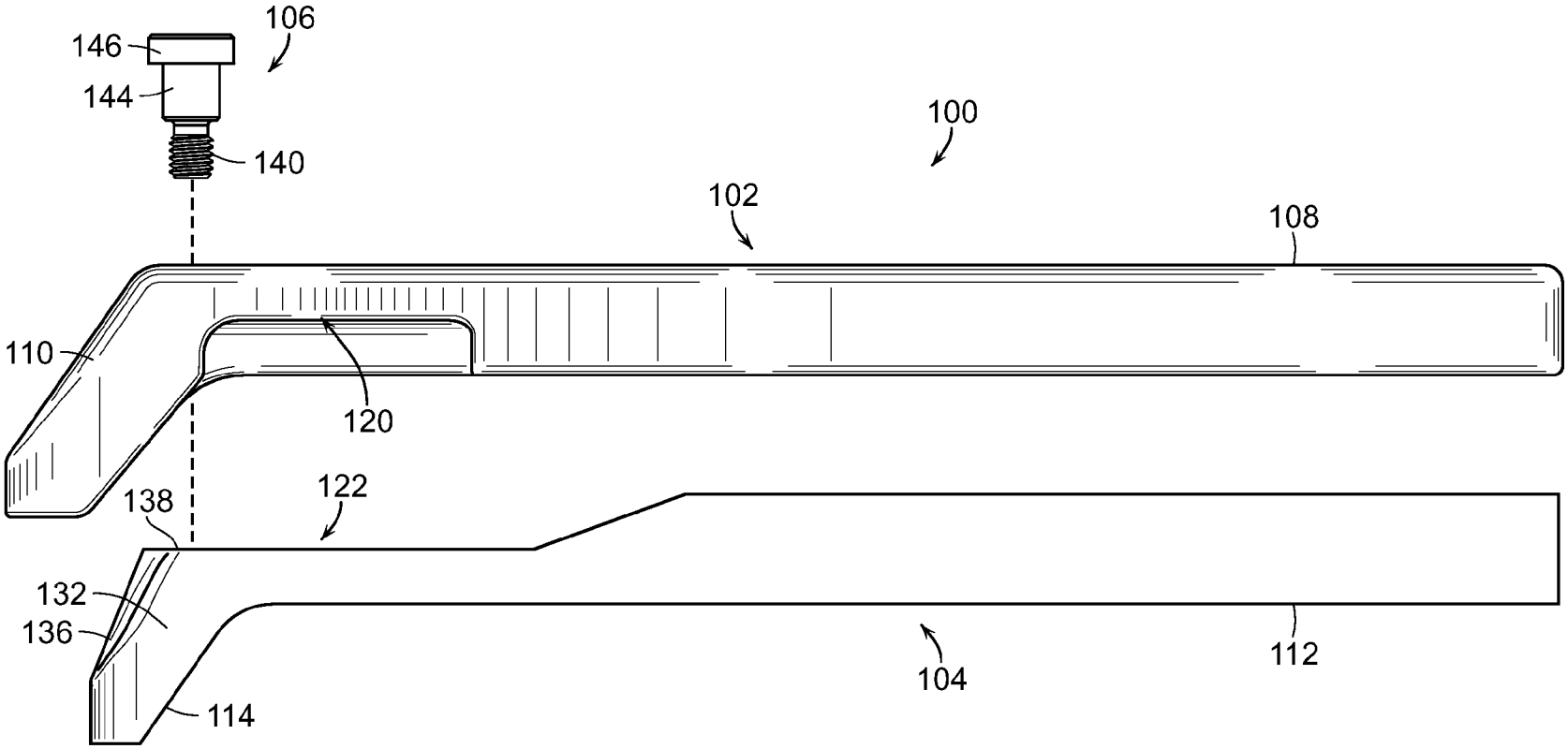
FIG. 5 is a side exploded view of the component parts of the tool of the present invention.

With reference now to FIG. 4, a tool 100 embodying the present invention is shown being grasped by a hand 2 of a user thereof. The wrenching tool 100 of the present invention is designed and configured so as to be manually operated by a single hand of a user in order to remove the attached collar 24 from the pin 10 of a torque controlled or frangible collar fastener. As illustrated in FIG. 5, which is a side exploded view of the tool 100, the tool 100 is generally comprised of a first elongated handle 102, and a second elongated handle 104 which is pivotally connected to the first elongated handle 102 by a connector fastener or pin 106.

Figure 6:
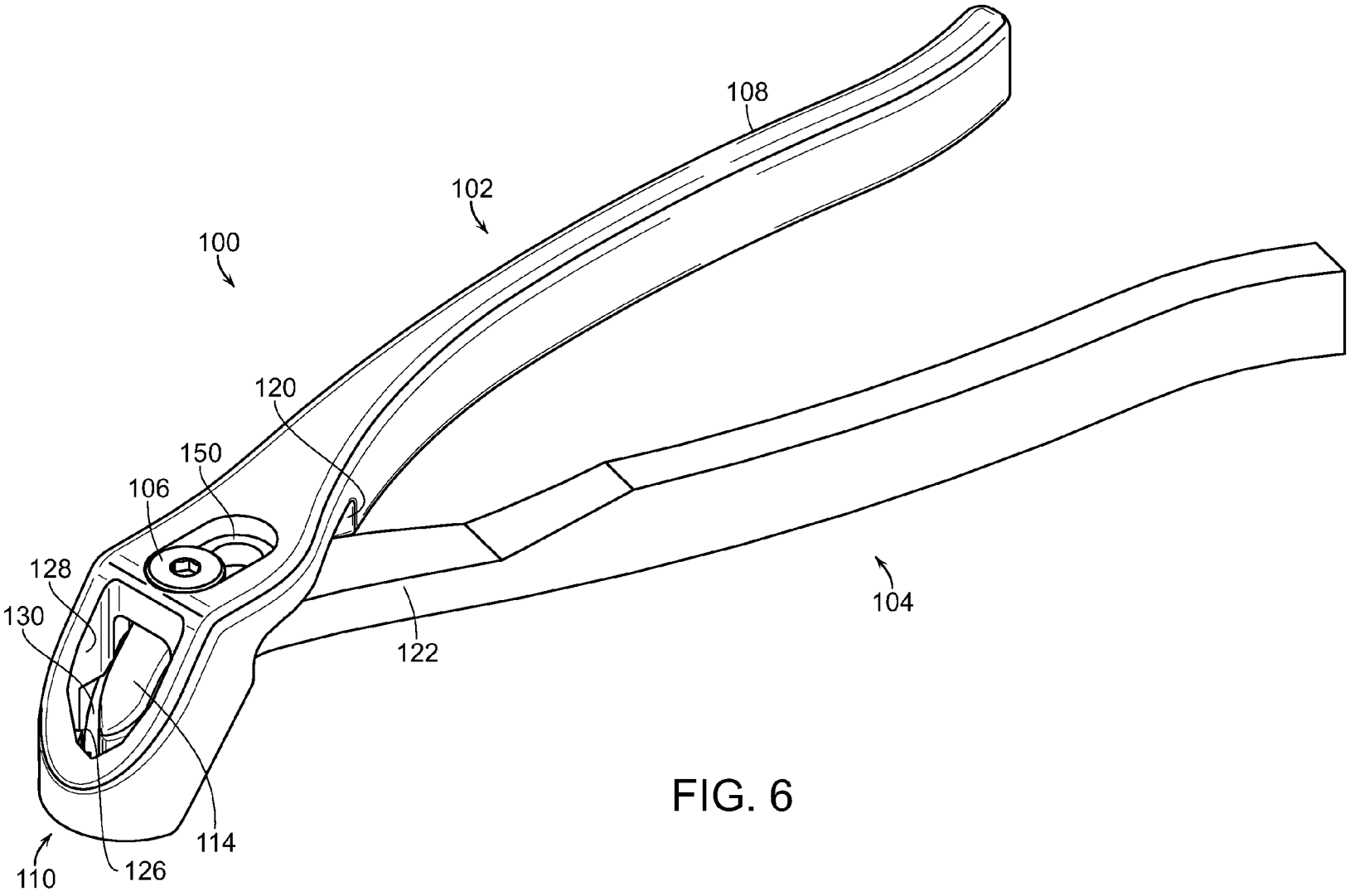
FIG. 6 is a front perspective view of the tool embodying the present invention.
Figure 7:
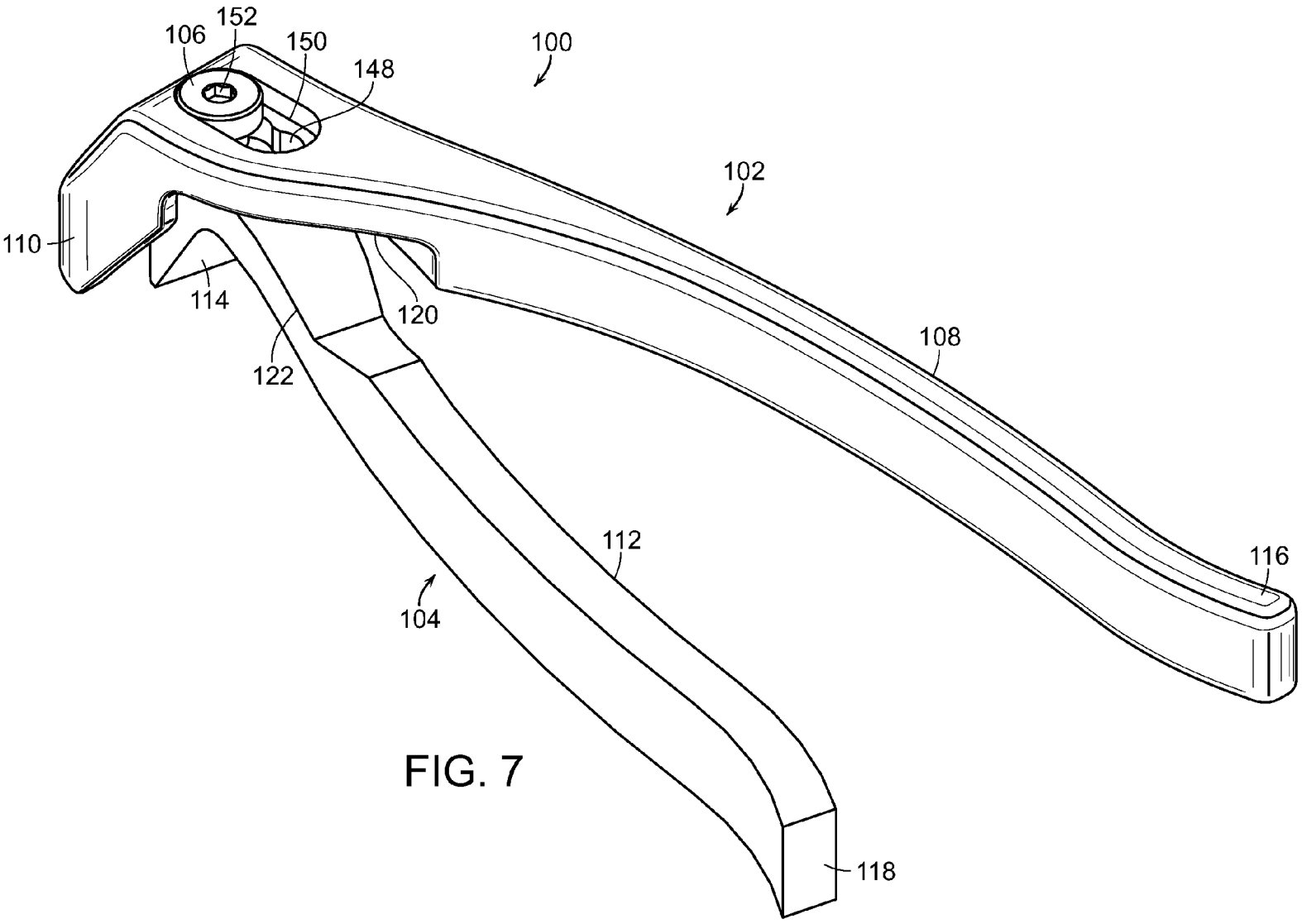
FIG. 7 is a rear perspective view of the tool embodying the present invention.

With reference now to FIGS. 5-7, the first elongated handle 102 includes a grip portion 108 at generally one end thereof and a socket head 110 at a generally opposite end thereof, which is configured and designed so as to receive a collar 24 of the torque controlled or frangible collar fastener therein. Similarly, the second elongated handle 104 includes a grip portion 112 at generally one end thereof and a jaw 114 at a generally opposite end thereof, which at least partially resides within a cavity of the socket head 110 and cooperates with the socket head 110 in removing the collar 24 of the torque controlled or frangible collar fastener, as will be more fully described herein.

The grip portions 108 and 112 of the first and second handles 102 and 104 may be of a curved configuration so as to provide comfort to the hand of the user while he or she grips and compresses the handles 102 and 104 towards one another. One such configuration, as illustrated herein, is of a generally "5" configuration, wherein the ends of the handles 102 and 104 flare outwardly, the handle adjacent to the ends curved inwardly, and then an immediately adjacent portion once again curves outwardly. Such a configuration provides comfort to the hand grasping the handles 102 and 104, the outward flare of the ends 116 and 118 of the handles 102 and 104 prevents the user's hand from slipping off of the handles 102 and 104, and the general configuration can also provide a mechanical advantage when pressing the handles 102 and 104 towards one another when grasping the grip portions 108 and 112.

Figure 9:
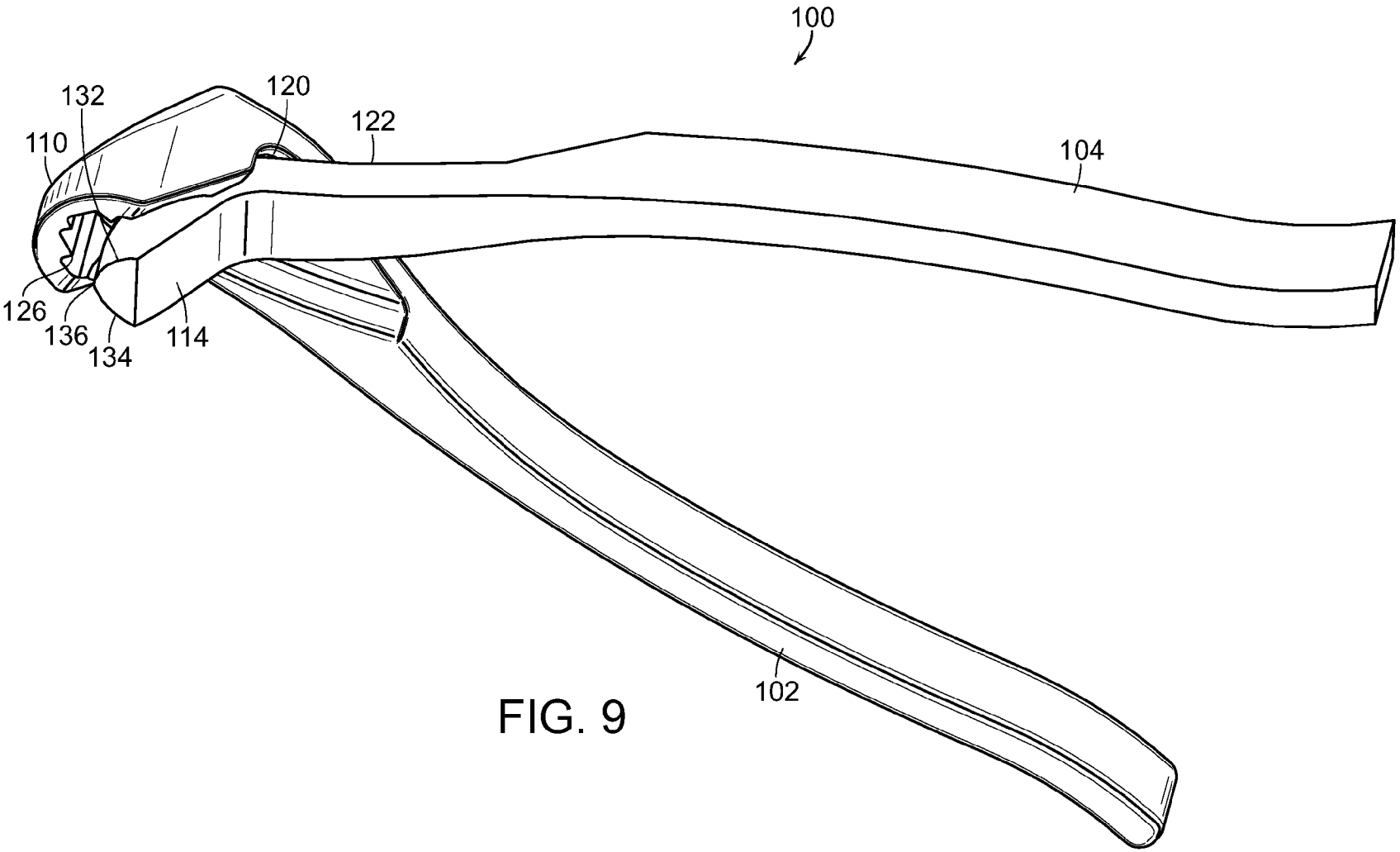
FIG. 9 is a bottom perspective view illustrating a jaw of a handle disposed relative to the socket head of the other handle as an assembled tool of the present invention.

With continuing reference to FIGS. 5-7, the first handle 102, intermediate the gripping portion 108 and socket head 110, and typically adjacent to the socket head as illustrated, has a landing 120 defined by an area of decreased cross-sectional thickness. In the illustrated embodiment, the second handle 104, also intermediate the gripping portion 112 and the jaw 114 has a landing 122 defined by an area of decreased cross-sectional thickness. As can be seen in the figures herein, the landings 120 and 122 of the first and second handles 102 and 104 overlie one another to permit the first and second handles 102 and 104 to be pivotally moved with respect to one another. It can be seen, for example, in FIG. 9 that the landing 120 of the first handle 102 has a configuration, such as a generally arcing or triangular configuration such that the landing 122 of the second handle 104 can freely move as the handle 104 is pivoted between opened and closed positions. The incorporation of the overlying landings 120 and 122 also assist in providing a gap between the handles 102 and 104 and the working surface.

Figure 8:
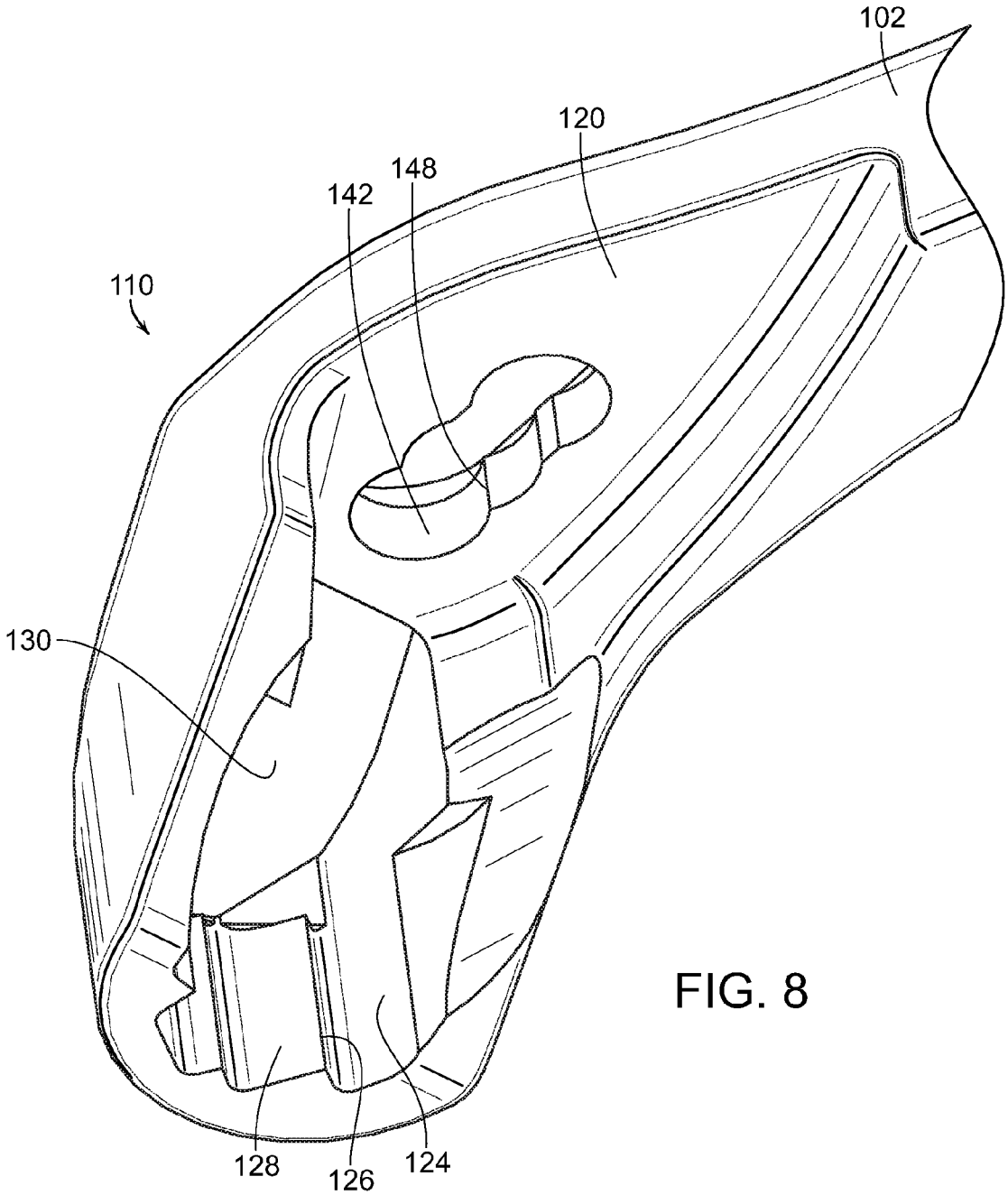
FIG. 8 is a partially fragmented and perspective view of a socket end of a handle of the tool, embodying the present invention
Figure 10:
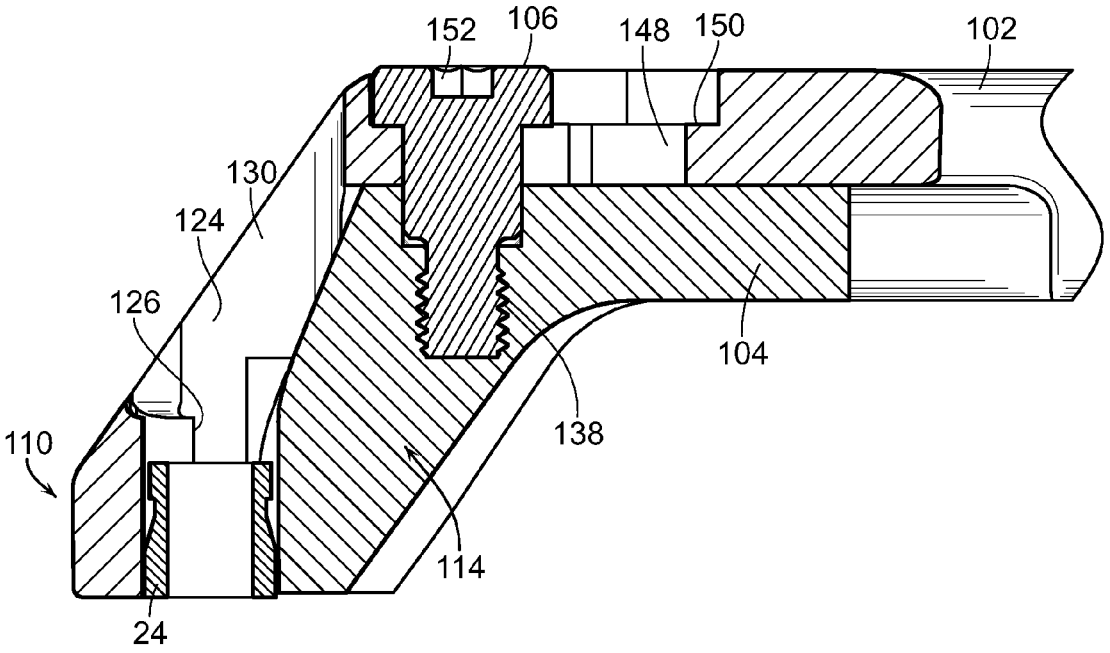
FIG. 10 is a cross-sectional view, illustrating the interconnection of the two handles of the tool of the present invention, and a collar disposed between the socket and jaw thereof, in accordance with the present invention.

With reference now to FIGS. 6 and 8, the socket head 110 of the first handle 102 defines a cavity 124 configured to receive a collar 24 of the torque controlled or frangible collar fastener therein, as illustrated in FIG. 10. In a particularly preferred embodiment, the socket head 110 is generally semi-cylindrical in configuration and extends downwardly from the handle 102 at an angle, typically between 90° and 45°. The socket head 110 is of a size and length so as to elevate the handles 102 and 104 with respect to the working surface when engaged with a collar 24 of a fastener so as to provide sufficient clearance for the user's fingers and knuckles to clear the working surface, as illustrated in FIGS. 4 and 10.

With particular reference to FIG. 8, a plurality of teeth 126 are formed on an inner surface of the socket head 110. Such teeth 126 may be comprised of elongated ridges which extend substantially the length of the interior surface of the socket head 110. Such ridges 126 may be formed, for example, by semi-cylindrical or angled cut outs 128 formed in the inner surface of the socket head 110, and which extends substantially the length of the socket wall, from generally an upper edge thereof to a lower edge thereof, as illustrated in FIG. 8. Typically, there are three teeth or ridges 126 which are spaced apart from one another and formed on the inner surface of the socket head 110, although the number can vary as needed. As the inner surface of the socket head 110 is curved, the teeth 126 which grip the collar 24 are spaced at angles, such as approximately 60°, apart from one another, so as to securely grip and bite into the collar 24 as the collar is forced against them as the curved, cam surface of the jaw 114 applies increasing pressure against the collar 24 as the handles of the tool are moved towards one another, allowing the secure gripping of the collar 24 and its removal as the tool 100 is manually rotated to remove the collar 24 from the threaded pin 10. The distance and angles between the teeth can vary to accommodate different sized collars.

As shown in the accompanying drawings, including FIGS. 6 and 10, the socket head 110 includes an aperture or window 130 which extends therethrough. This aperture 130 serves the purpose of enabling the worker to see the collar 24 as it is inserted into the cavity 124 of the socket head 110. Furthermore, the through aperture 130 enables the insertion of a hex key or the like if it is necessary to insert the hex key into the hex recess 20 of the pin 10, in order to immobilize the pin 10 while the collar 24 is removed therefrom.

Figure 11:
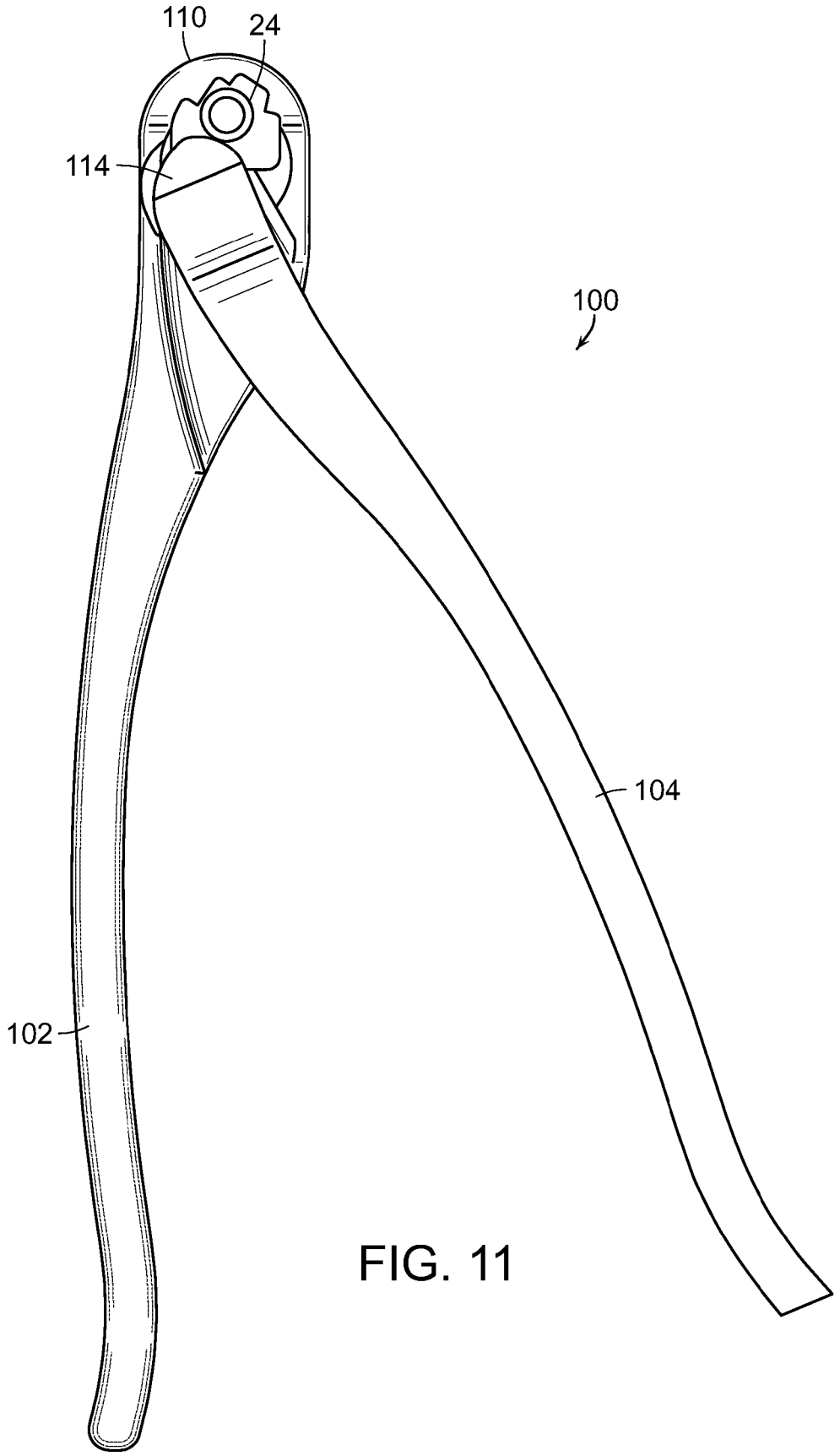
FIG. 11 is a bottom view illustrating a collar disposed within the socket head of the tool.
Figure 12:
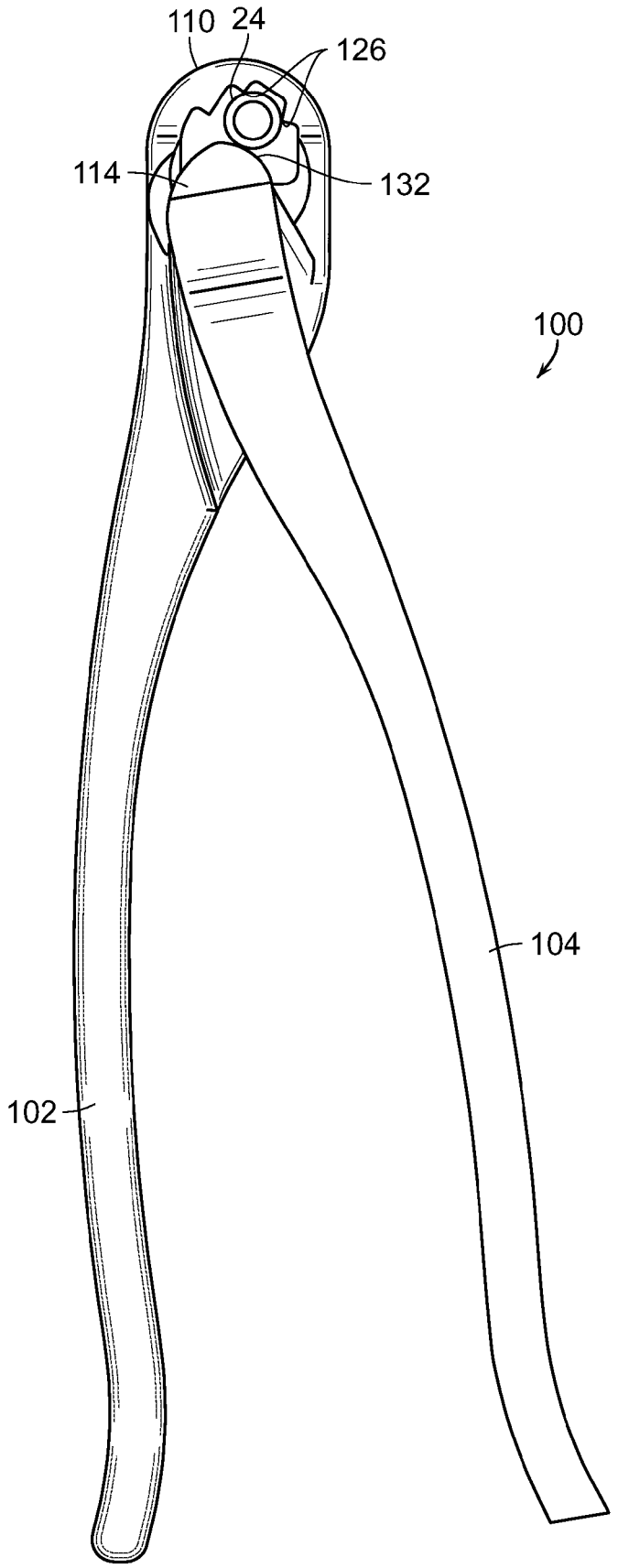
FIG. 12 is a bottom view similar to FIG. 11, illustrating the jaw being brought into contact with the collar and forcing it into engagement with teeth of the socket head so as to remove the collar from the pin of the fastener, in accordance with the present invention.

With reference again to FIGS. 5-7, the jaw 114 at the end of the second handle 104 is positioned relative to the socket head 110 so as to permit a collar 24 to be inserted between the inner surface of the socket head 110 and the outer surface of the jaw 114, and as the second handle 104 is pivoted into a closed position, the collar 24 is pushed into engagement with the teeth 126 of the socket head 110 as the curved surface 132 of the jaw 114 comes into contact with the collar 24. The curved surface 132 comprises a cam surface to provide a cam action of the jaw 114 as handle 104 is moved towards handle 102, applying increasing pressure, with a mechanical advantage, against the collar 24 causing it to come into frictional engagement with two or more teeth 126, as illustrated in FIGS. 11 and 12. The generally opposite surface 134 of the jaw 114, which meets the cam surface 132 at point 136, may be curved, but typically does not provide any mechanical action against or come into contact with the collar 24.

With reference now to FIGS. 10-12, in order to remove a collar 24 from the pin 10 of the assembled fastener, the exposed collar 24 is inserted into the cavity 124 of the socket head 110, between the teeth 126 of the socket head 110 and the jaw 114, as illustrated in FIG. 10. With the handles 102 and 104 in the open position, it can be seen in FIG. 11 that there is space between the collar 24 and the inner surface of the socket head 110 and the jaw 114. However, as the handles 102 and 104 are brought towards one another in the closed position, as illustrated in FIG. 12, the jaw 114, and particularly the collar-engaging cam surface thereof 132, engages the collar 24 and pushes it into engagement with teeth 126 of the socket head 110. Increasing force is applied to the collar 24 as the cam 132 increasingly extends into the socket head 110. In such a clamped position between the jaw 114 and the teeth 126 of the socket head 110, the tool 100 can be rotated, causing the collar 24 to be rotated and unthreaded from the pin 10. This can be done with a single hand 2 of the user, as illustrated in FIG. 4, unless a problem is encountered with the pin 10 rotating as the collar 24 is rotated, allowing the other hand of the worker to insert a hex key into the through aperture 130, and into the hex recess 20 of the pin 10 to immobilize it as the collar 24 is rotated as the tool 100 is rotated in its closed and clamped position, causing the collar 24 to become unthreaded from the pin 10 and removed therefrom.

Torque fastening systems come in various sizes. As such, the collar 24 is of varying sizes, and more particularly of varying outer diameters. The present invention contemplates this by adjustably connecting the first and second handles 102 and 104 to one another to permit the distance between the teeth 126 of the socket head 110 and the jaw 114 to be varied to accommodate collars 24 of different sizes.

In the illustrated embodiment, the second handle 104 includes an internally threaded aperture 138. The threaded portion 140 of the connector 106 is then threaded through an aperture 142 of the first handle 102 and into the threaded aperture 138 of the second handle 104, so as to join the first and second handles 102 and 104. At least a portion 144 of the connector 106 is not threaded, and is typically of a slightly larger diameter than the threaded portion 140. The head 146 of the connector 106 is of an even greater diameter. It will be appreciated that instead of a threaded pin, a pressed pin could be used.

As can be seen in the various figures, including FIGS. 7 and 10, the first handle 102 includes a series of apertures 142 and 148, which may be at least partially coextensive with one another such that the connector 106 can be inserted into one of the series of apertures 142 or 148 and when fastened to the second handle 104 position the jaw 114 either closer or farther away from the interior surface and teeth 126 of the socket head 110. The apertures 142 and 148 are of a sufficiently large diameter so as to accept the head 146 of the connector 106 therein, but the head 146, being of a greater diameter, engages a peripheral ledge 150 to allow the fastening of the first and second handles 102 and 104 as the connector 106 is secured into the threaded aperture 138 of the second handle 104. However, the non-threaded portion 144 allows pivotal movement of the handles 102 and 104 with respect to one another. If a larger collar 24 is required to be removed, the connector 106 can be loosened somewhat, such as by inserting a hex key into the hex recess 152 of the connector 106 and rotating the connector 106 to loosen it, the loosened connector 106 can be moved into an adjacent aperture or recess 148 and tightened again, so as to position the jaw 114 farther away from the inner surface of the socket head 110 to accommodate the larger collar 24.

Three apertures or recesses are illustrated which enable the tool 100 of the present invention to accommodate the most common collar sizes of torque controlled or frangible collar fasteners which are typically used in the aerospace industry, although it will be appreciated by those skilled in the art that additional or fewer apertures and recesses could be included to accommodate fewer or a greater range of collar sizes. With reference again to FIGS. 11 and 12, a collar 24 of a relatively small or medium size is illustrated, wherein the collar 24 is pressed into frictional engagement with the teeth 126 at the far right, as viewed in FIG. 12, of the socket. However, when removing a larger collar, the cam surface 132 of the jaw 114 would possibly press the collar 24 into engagement with the outermost teeth on the left and right, as looking from the bottom as shown in FIG. 12. Moreover, handle 104 may need to be adjusted with respect to handle 102 to provide sufficient distance between the jaw 114 and the socket wall such that the larger collar 24 can fit therein. This may be done, as mentioned above, by moving connector 106 into one of the series of recesses, such as recess 148.

It will be appreciated by those skilled in the art that it takes very little effort to initially grip the collar 24. Once minimal grip is established the mechanical advantage of the cam surface 132 takes over. As rotational force is applied, the cam continually produces additional force capturing the collar between the cam surface 132 and the opposing teeth of the socket to grip it increasingly tighter, preventing slippage as the collar is removed from the pin. The cam surface 132 can have serrations or a diamond cut or the like to provide improved grip over the smooth cam surface. Unlike conventional pliers, the clamping force or grip experienced by the fastener does not depend upon squeezing the handles together. The cam action and clamping increases as the rotational force applied to one of the handles increases. The cam makes possible much larger clamping ratios and does not require continual squeezing of the pliers' handles together. Once the cam is engaged with the collar, very little, if any, additional squeezing of the handles is required. Cam engagement is maintained and increased as removal torque is applied to one handle of the tool. Therefore, a relatively nominal rotational torque applied through the cam can produce a much larger clamping torque without slipping. This ensures removal of the fastener and reduces operator fatigue as minimal gripping with the hand is required.

The present invention provides many advantages over currently used tools. One advantage of the tool 100 of the present invention is that the handles are elevated with respect to the working surface, allowing the tool to be positioned over a fastened collar 24 and the operator being able to rotate the tool without his or her knuckles or other portion of the hand coming into contact with adjacent fastened collars or other raised objects. Another advantage of the present invention is that the jaw of the handle can engage not just the relatively thin lower portion of the base of the collar 24, but at nearly any point along the collar and still effectively work. The tool 100 of the present invention can also be used in connection with collars and fasteners of different sizes and diameters, whereas the prior art requires a different tool for each different sized fastener.

Although several embodiments have been described in detail for purposes of illustration, various modifications may be made without departing from the scope and spirit of the invention. Accordingly, the invention is not to be limited, except as by the appended claims.

What is claimed is:

1. A hand wrenching tool for removing installed collars of torque controlled or frangible fasteners, comprising:

a first elongated handle providing a grip at one end thereof and a socket head at a generally opposite end thereof, the socket head defining a cavity having a through aperture and configured to receive a collar of the fastener therein and having an interior wall defining a plurality of teeth; and a second elongated handle pivotally connected to the first elongated handle by a connector extending downwardly from a top surface of the first elongated handle, and having a grip at one end thereof and a jaw at an opposite end thereof having a collar engaging cam surface;

wherein the socket head comprises a generally semi-cylindrical wall that extends downwardly away from the top surface of the first handle at said opposite end at an angle of between 45 and 90 degrees, and is of a length or size to elevate the handle with respect to a work surface to provide create a hand gripping clearance space between the work surface and the gripping portions of the first and second handles when the socket head is placed over the collar of the fastener;

wherein the first handle and the second handle are adjustably connected to one another to permit the distance between the teeth and the jaw to be varied to accommodate collars of different sizes;

wherein upon pivoting the grips of the first and second handles towards one another, the cam surface of the jaw increasingly projects into the socket and pushes the collar of the fastener into engagement with the socket teeth and facilitate the removal of the collar from a threaded pin of the fastener as the hand wrenching tool is manually rotated.

2. The tool of claim 1, wherein one of the first or the second handle includes a series of connecting apertures alignable with a connecting aperture of the other first or second handle for insertion of the connector therein to adjust the distance between the teeth and the jaw.

3. The tool of claim 1, wherein the teeth comprise a plurality of cut outs formed in the interior wall of the socket.

4. The tool of claim 3, wherein the cut outs extend from substantially an upper edge to a lower edge of the socket wall.

5. The tool of claim 1, wherein the first handle includes a landing defined by an area of decreased cross-sectional thickness intermediate the socket head and the gripping portion, and the second handle includes a landing defined by an area of decreased cross-sectional thickness intermediate the jaw and the gripping portion of the second handle, the landings of the first and second handles overlying one another to permit the first and second handles to be pivotally moved with respect to one another.

6. The tool of claim 1, wherein the collar engaging surface comprises an arc-shaped cam.

7. The tool of claim 6, wherein the arc-shaped cam surface increasingly projects into the socket as the second handle is moved towards the first handle.

* * * * *